US005983622A

United States Patent [19]

Newburry et al.

[11] Patent Number: 5,983,622

[45] Date of Patent: Nov. 16, 1999

[54] DIFFUSION FLAME COMBUSTOR WITH PREMIXING FUEL AND STEAM METHOD AND SYSTEM

[75] Inventors: Donald Maurice Newburry; Douglas Dean Darling, both of Orlando, Fla.

[73] Assignee: Siemens Westinghouse Power Corporation, Orlando, Fla.

[21] Appl. No.: 08/816,374

[22] Filed: Mar. 13, 1997

[51] Int. Cl.[6] ..... F02C 3/30

[52] U.S. Cl. ..... 60/39.05; 60/39.03; 60/39.59

[58] Field of Search ..... 60/39.05, 39.141, 60/39.3, 39.48, 39.59

[56] References Cited

U.S. PATENT DOCUMENTS

| | | | |
|---|---|---|---|
| 3,263,421 | 8/1966 | Londal | 60/39.141 |
| 3,804,579 | 4/1974 | Wilhelm | 431/211 |
| 4,982,570 | 1/1991 | Waslo et al. | 60/733 |
| 5,002,481 | 3/1991 | Forster | 431/208 |
| 5,095,693 | 3/1992 | Day | 60/39.59 |
| 5,127,822 | 7/1992 | Nakayama et al. | 431/10 |
| 5,285,628 | 2/1994 | Korenberg | 60/39.05 |
| 5,328,355 | 7/1994 | Kobayashi et al. | 431/10 |
| 5,357,741 | 10/1994 | Talabisco et al. | 60/39.3 |
| 5,365,738 | 11/1994 | Etheridge | 60/742 |
| 5,372,008 | 12/1994 | Sood | 60/737 |
| 5,404,711 | 4/1995 | Bajput | 60/39.463 |
| 5,410,884 | 5/1995 | Fukue et al. | 60/747 |
| 5,488,355 | 1/1996 | Tindall et al. | 340/578 |
| 5,511,970 | 4/1996 | Irwin et al. | 431/9 |

FOREIGN PATENT DOCUMENTS

| | | |
|---|---|---|
| 0521443A1 | 1/1993 | European Pat. Off. . |
| 164779A | 1/1934 | Switzerland . |
| 2141815A | 1/1985 | United Kingdom . |
| 2034873A | 6/1990 | United Kingdom . |

*Primary Examiner*—Louis J. Casaregola

[57] ABSTRACT

A method and system for combusting a liquid fuel stream in a diffusion flame combustor by spraying the liquid fuel stream into a steam flow to produce a fuel/steam flow with atomized liquid fuel therein. The fuel/steam flow is further mixed before being combusted in the diffusion flame combustor to produce at least a first portion of an emission stream therefrom.

16 Claims, 3 Drawing Sheets

Comparsion of Emissions of Separate Fuel and Steam Flows Combustion with Emissions of a Fuel/Steam Flow Combustion in a Diffusion Flame Combustor

DIFFUSION FLAME COMBUSTOR WITH PREMIXING FUEL AND STEAM METHOD AND SYSTEM

BACKGROUND OF THE INVENTION

The current invention relates to liquid fuel injection methods and systems for use with diffusion flame combustors.

In diffusion flame combustors, there is a significant amount of $NO_x$ produced in the high temperature regions of flame. This is the result of $NO_x$ production being exponentially dependent on temperature. The prior art discloses injecting water or steam into the diffusion flame combustors, via an inlet separate from the fuel inlet, to decrease the peak flame temperature and lower the production of $NO_x$.

The prior art discloses a number of problems resulting from injecting water or steam into the diffusion flame combustor. As the water or steam and fuel is injected into the combustor through different inlets, the combustion zone has uneven distributions of oil and steam resulting in locally hot and cold regions therein. The hot regions result in high $NO_x$ production and the cold regions result in high CO production, as the rate of CO oxidation to $CO_2$ is much lower at reduced temperatures. Also, the stability of the combustion process is reduced with the injection of water or steam into the combustors due to unequal heat release from the hot and cold regions.

SUMMARY OF THE INVENTION

The present invention provides a method and system of combusting a liquid fuel stream in a diffusion flame combustor comprising the step of spraying the liquid fuel stream into a steam flow to produce a fuel/steam flow with atomized liquid fuel therein. The fuel/steam flow is further mixed before being combusted in the diffusion flame combustor to produce at least a first portion of an emission stream therefrom.

DETAILED DESCRIPTION OF THE PREFERRED EMBODIMENTS

Figure 1:
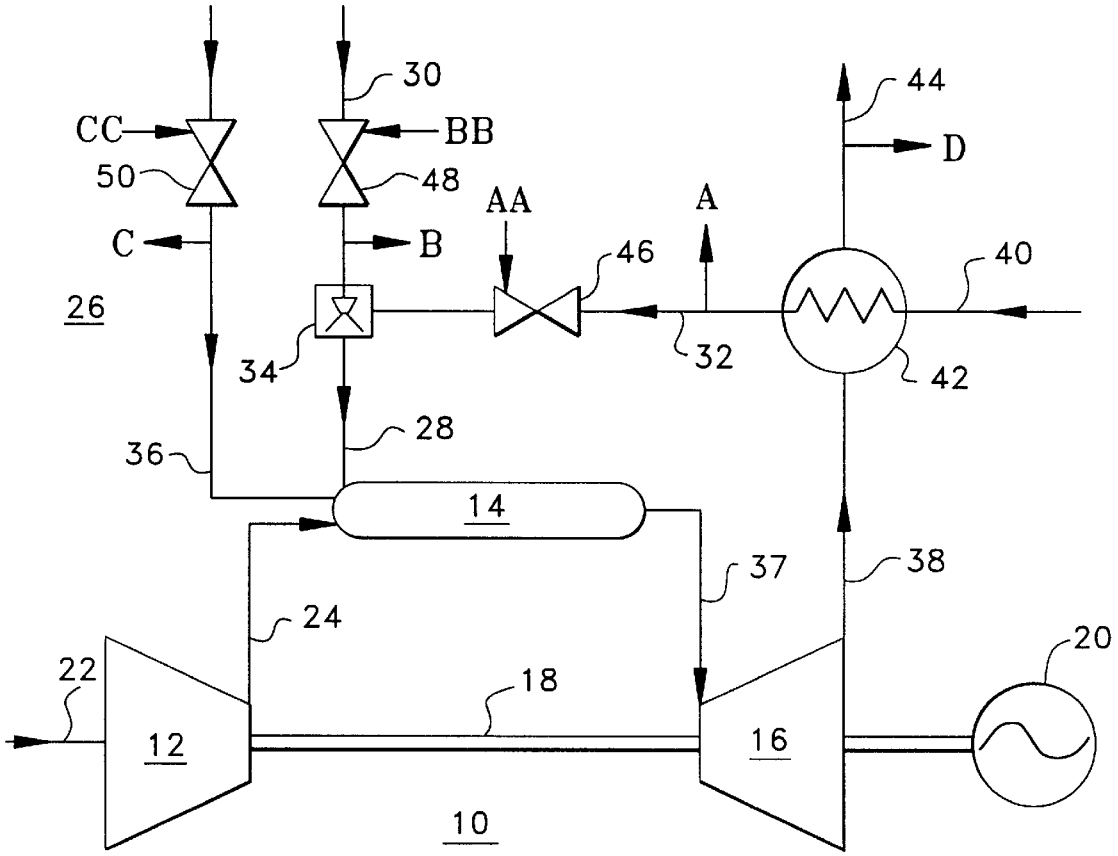
FIG. 1 shows a schematic diagram of a turbine system with diffusion flame combustors and an atomizing means for spraying liquid fuel into a steam flow according to an embodiment of the invention.

Referring to the drawings, wherein like reference numerals refer to like elements, and referring specifically to FIG. 1, a turbine system 10 is comprised of a compressor 12, one or more diffusion flame combustors 14, and an expander 16. A shaft 18 extending through the compressor 12 and the expander 16 provides shaft power to a generator 20. During operation, an air stream 22 is directed into the compressor 12, compressed, and released as a compressed air stream 24.

The compressed air stream 24 is then directed to the diffusion flame combustors 14 where it is used to combust fuel that is delivered via a fuel delivery system 26. The combustion of the fuel produces an emission stream 37 that is directed to the expander 16.

The fuel delivery system 26 delivers a fuel/steam flow 28 and a start-up fuel stream 36 to the diffusion flame combustors 14. The fuel/steam flow 28 is formed by a fuel stream 30 being atomized by an atomizing means 34 as it is sprayed into a steam line 32. The fuel/steam flow 28 is then mixed as it travels to the diffusion flame combustors 14. The mixing of the fuel/steam flow 28 prior to entering the combustors 14 results in the reduction, if not elimination, of local hot and cold regions in the combustor, caused by uneven fuel/steam ratios, that increase the amount of $NO_x$ and CO produced during combustion. Also, combustion stability is increased as the combustion occurs more uniformly with fewer local hot and cold regions. The function of start-up fuel stream 36 is discussed below.

The emission stream 37 is expanded in the expander 16 to produce an expanded emission stream 38. The expanded emission stream 38 is directed through a heat exchanger means 42 that transfers heat energy from the expanded emission stream 38 and into a water stream 40 to produce the steam flow 32. A cooled, expanded emission stream 44 then exits the heat exchanger means 42. The heat exchanger means 42 may include a shell-in-tube heat exchanger, a heat recovery steam generator, a boiler, or other suitable means. In additional embodiments of the invention, the heat energy may be transferred to the water stream 40 from the emission stream 37 or the steam flow 32 may be supplied by other means that may or may not take advantage of the heat energy in either of the emission steams 37 and 38.

In the embodiment of the invention shown in FIG. 1, the steam flow 32 cannot be generated until an emission stream 37 is first generated. Therefore, the start-up fuel stream 36 delivers fuel to the diffusion flame combustors 14 until the emission stream 37 has been produced long enough to generate the requisite amount of steam flow 32 to produce the fuel/steam flow 28. In a preferred embodiment of the invention, the switch between the start-up fuel stream 36 and the fuel/steam flow 28 is not abrupt, but rather the start-up fuel stream 36 may be reduced while the fuel/steam flow 28 increases.

Figure 2:
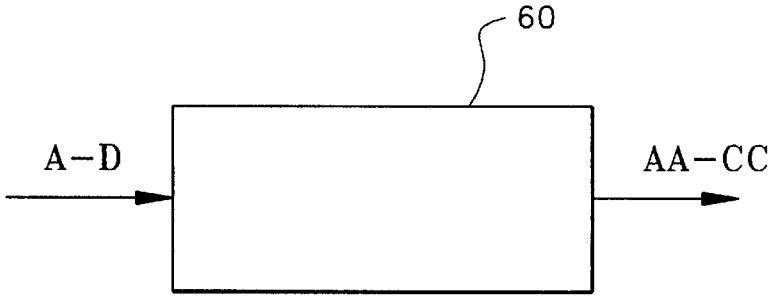
FIG. 2 shows the control means for directing the turbine system with diffusion flame combustors according to an embodiment of the invention.

Now referring to FIGS. 1 and 2, a control means 60 controls the flows of the steam flow 32, the fuel stream 30, and the start-up fuel stream 36 into the diffusion flame combustors 14 by directing control valves 46, 48, and 50 respectively installed in those lines. In a preferred embodiment of the invention, the control means 60 may be a computer system capable of receiving inputs, carrying information concerning various conditions and properties of the turbine system 10 and transmitting outputs for directing various components of the turbine system. Other embodiments of the invention may include turbine system operating personnel determining the conditions and properties of the system and directing various components of the system manually or by other suitable means.

The control means 60 receives an input A that contains information concerning the properties of the steam flow 32. In a preferred embodiment of the invention, input A may have information concerning the temperature and pressure of the steam flow 32. Other embodiments of the invention may use other inputs to determine the status of the steam flow 32, such as information concerning the properties of the emission stream 38. Other embodiments of the invention may include more or less properties. When the properties of the steam flow 32 are below the minimum requirements for spraying fuel 30 thereinto, such as at start-up of the system, the control means 60 directs control valves 46 and 48 to close via outputs AA and BB, respectively, to prevent delivering an inadequate fuel/steam flow 28 to the diffusion flame combustors 14. Additionally, the control means 60 directs the control valve 50 to open via output CC to deliver the start-up fuel stream 36 to the combustors. The control means 60 monitors the properties of the start-up fuel stream 36 via information received from an input C. In a preferred embodiment of the invention, the properties of the start-up fuel stream 36 may include flow rate, while other embodiments of the invention may include different or additional properties.

The properties of the steam flow 32 reach a steady state condition after the turbine system has been operating for a period of time. When the control means 60 receives indication that the steady state condition has occurred, via input A, it directs control valve 46 to open via output AA such that non-premixed fuel and steam are entering the combustors. Once the proper stream flow is established and stabilized, the control means directs control valve 50 to close via output CC and directs control valve 48 to open via output BB. At this point, the total fuel source for the diffusion flame combustors 14 is the fuel/steam flow 28. In a preferred embodiment of the invention, the control means 60 monitors the properties of the steam flow 32 via input A, such as temperature, pressure, and flow rate, and the properties of fuel stream 30 via input B, such as flow rate. Other embodiments of the invention may monitor different or additional properties or monitor the properties of the fuel/steam flow 28 directly. Based upon the inputs A and B, the control means may direct the control valves 46 and 48, via outputs AA and BB, to restrict or enlarge the flow rates of the steam flow 32 and the fuel stream 30 to maintain an appropriate flow rate and steam-to-fuel ratio of the fuel/steam flow 28.

A preferred embodiment of the invention may ramp up the delivery of the fuel/steam flow 28 to the diffusion flame combustors 14 instead of abruptly switching from the delivery of the start-up fuel 36 to the delivery of the fuel/steam flow 28. The control means 60 directs, via output BB, the control valve 48 to partially open when it determines, via input A, that the steam flow 32 has reached the minimum requirements for spraying the fuel stream 30 thereinto. The control means 60 simultaneously directs the control valve 50 to partially close, thereby reducing the flow of the start-up fuel stream 36 to compensate for the delivery of the fuel/steam flow 28. This procedure continues until the flow of the start-up fuel stream 36 is arrested.

In a preferred embodiment of the invention, the control means 60 may also direct the flow and composition of the fuel/steam flow 28 based upon one or more measurements of the composition of the expanded, cooled emission stream 44. One such measurement is the $NO_x$ level of the expanded, cooled emission stream 44. The control means 60 receives the $NO_x$ level measurement of the stream 44 via input D. If the stream 44 has an $NO_x$ level above an $NO_x$ emission ceiling limit, the control means 60 increases the steam-to-fuel ratio of the fuel/steam flow 28 by either increasing the flow rate of the steam flow 32, decreasing the flow rate of the fuel stream 30, or a combination thereof. As the turbine system efficiency increases when more fuel is delivered to the combustors 14, the control system 60 decreases the steam-to-fuel ratio of the fuel/steam flow 28 when the $NO_x$ level in the emission stream 44 is below an $NO_x$ emission floor limit. Other embodiments of the invention may monitor the $NO_x$ levels of any emission stream and adjust the steam-to-fuel ratio accordingly.

In another preferred embodiment of the invention, the control means 60 may use the color measurement of the expanded, cooled emission stream 44 to direct the flow and steam-to-fuel ratio of the fuel/steam flow 28. The control means 60 receives the emission stream color measurement via input D. If the emission stream 44 has a yellow or orange tinge indicative of $NO_x$, the control means 60 increases the steam-to-fuel ratio of the fuel/steam flow 28 as described previously, thereby decreasing or eliminating the color. In other embodiments of the invention, the control means 60 may direct the flow and steam-to-fuel ratio of the fuel/steam flow 28 based upon any one of the below listed measurements of the composition of the stream 44 or a combination thereof: the $NO_x$ level, the color, the smoke level, the opacity, the unburned hydrocarbons, and the CO level.

Figure 3:
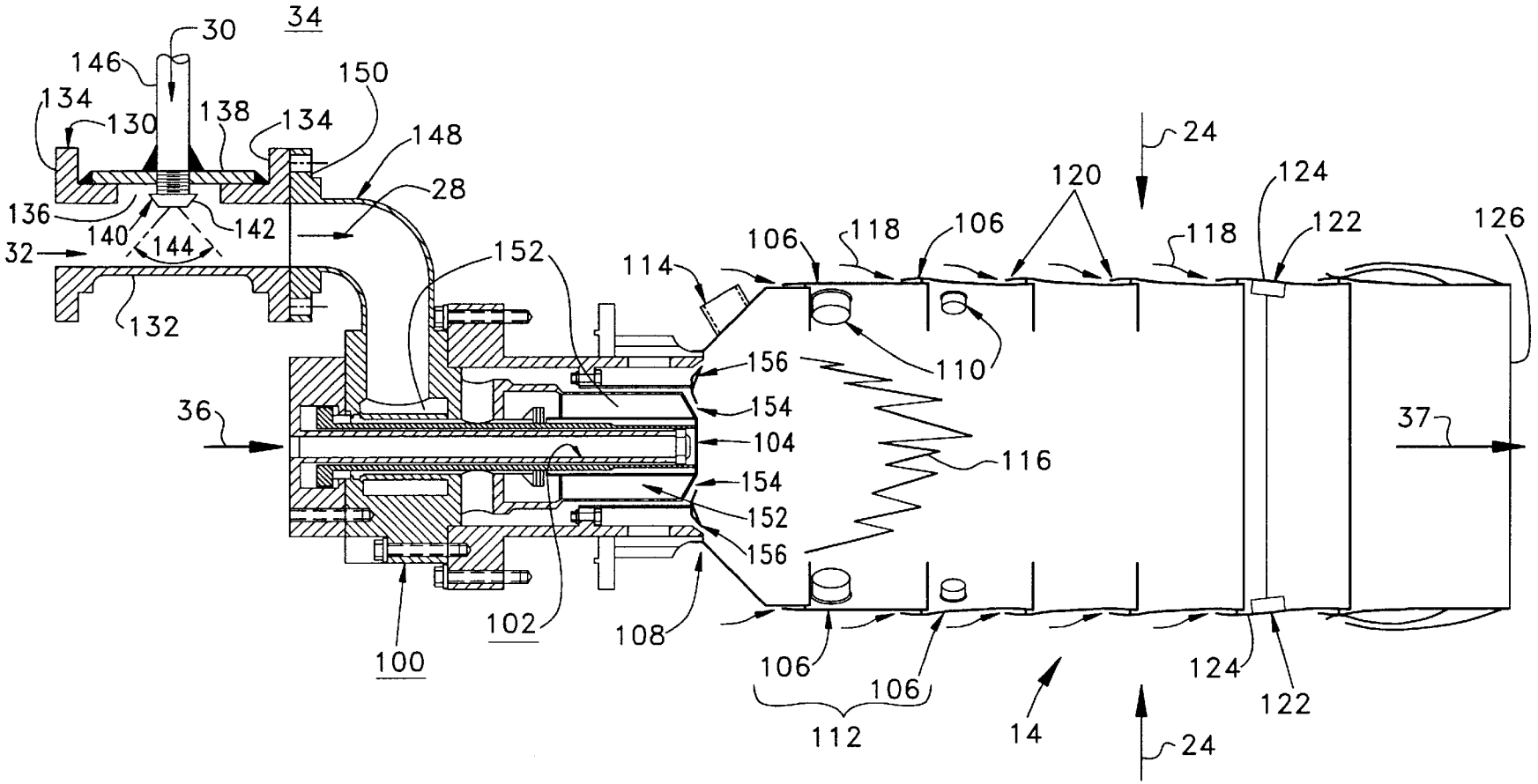
FIG. 3 shows sectional view of an atomizing means, fuel injection means, and an individual diffusion flame combustor according to an embodiment of the invention.

Now referring to FIG. 3, an individual diffusion flame combustor 14 is supplied both the fuel/steam flow 28 and the start-up fuel stream 36 through a fuel injector system 100 adjacent to an upstream end 108 of the combustor. The diffusion flame combustors 14 and the fuel injector 100 are commercially available through Westinghouse Electric Corp., 11 Stanwix St., Pittsburgh, Pa. 15222 as a W251 B11/12 Fuel Injector and Combustor. Other embodiments of the invention may use other suitable diffusion flame combustors and fuel injection systems.

The start-up fuel stream 36 flows into a liquid fuel injector assembly 102 located through the middle of the fuel injector system 100. As the start-up fuel stream 36 exits the injector assembly 102, it passes through a liquid fuel injector atomizer 104 and enters the diffusion flame combustor 14 at its upstream end 108. Combustion air streams 106 also enter the diffusion flame combustor 14 through combustion air inlet ports 110 located around the combustor's combustion zone 112 that is located downstream of the upstream end 108. An ignitor (not shown), disposed in an ignitor port 114, located between the combustion air inlet ports 110 and the upstream end 108, ignites the start-up fuel stream 36/combustion air streams 106 combination, thereby creating a flame 116 in the combustion zone 112.

The combustion reactions within the diffusion flame combustors 14 produce a portion of the emission stream 37. Other portions of the emission stream 37 include cooling air streams 118 and dilution air streams 122. The cooling air streams 118 enter the combustors 14 through cooling air inlet corrugations 120 in the walls of the combustor. The dilution air streams 122 enter the combustors 14 through dilution air inlet ports 124 located near the exit 126 of the combustor. The combustion air streams 106, cooling air streams 118, and dilution air streams 122 all come from the compressed air stream 24. Other embodiments of the invention may have at least portions of one or more air streams coming from sources other than the compressed air stream 24.

The atomizing means 34 for fuel stream 30 is a flanged spindle 130 comprised of a spindle portion 132 with two flanges 134 at either end thereof. A hole 136 has been cut into the spindle portion 132 and the hole 136 is spanned by a plate 138 welded to the portion. An atomizer 140 is tapped into the plate 138 such that the atomizer's nozzle 142 is directed into the spindle portion 132 but lies within the hole 136. In a preferred embodiment of the invention, the nozzle 142 has a spray angle 144 of approximately 75°. The fuel flow 30 is delivered to the atomizer 140 through a pipe 146 that has been welded to the outside of the plate 138. Other embodiments of the invention may have other suitable atomizing means 34, such as multiple nozzles, nozzles of different spray angles, and/or different configurations of the atomizing means 34.

The fuel/steam flow 28 is produced by the steam flow 32 traveling through the spindle portion 132 while the fuel stream 30 is sprayed through the nozzle 142 and into the steam flow. This is the first step in dispersing the fuel in the fuel/steam flow 28. The next step is mixing the fuel/steam flow 28 to reduce or eliminate concentrations of steam and fuel that result in local cold and hot regions in the combustor. In a preferred embodiment, the mixing may occur as the fuel/steam flow 28 travels out of the atomizing means 34 and through a fuel/steam inlet pipe 148. The fuel/steam inlet pipe 148 has a flanged entrance 150, through which the fuel/steam flow 28 enters, that is adjacent to the flange 134 that is downstream of the nozzle 142.

The fuel/steam flow 28 travels through the fuel/steam inlet pipe 148 and into a fuel/steam manifold 152 in the fuel injector system 100. The fuel/steam manifold 152 is annularly disposed about the liquid fuel injector assembly 102. The fuel/steam flow 28 further mixes as it travels through the manifold 152 before exiting through fuel/steam injection ports 154 at the upstream end 108 of the diffusion flame combustors 14. The fuel/steam mixture mixes and burns in the combustion zone 112 with air passing through the swirl plate 156 and combustion air 106.

The atomizing of the fuel stream 30 into the steam flow 32 to produce the fuel/steam flow 28 and the mixing thereof results in reduced CO and $NO_x$ levels in the emission stream 37. The production of CO is increased by low combustion temperatures, which occur in pockets of high steam concentration in the combustor. The production of $NO_x$ is increased by high combustion temperatures, which occur in pockets of high fuel concentration in the combustor. As mixing reduces, and preferably eliminates, the presence of local regions of high steam and high fuel concentrations, the production of CO and $NO_x$ is beneficially reduced.

EXAMPLE

Figure 4:
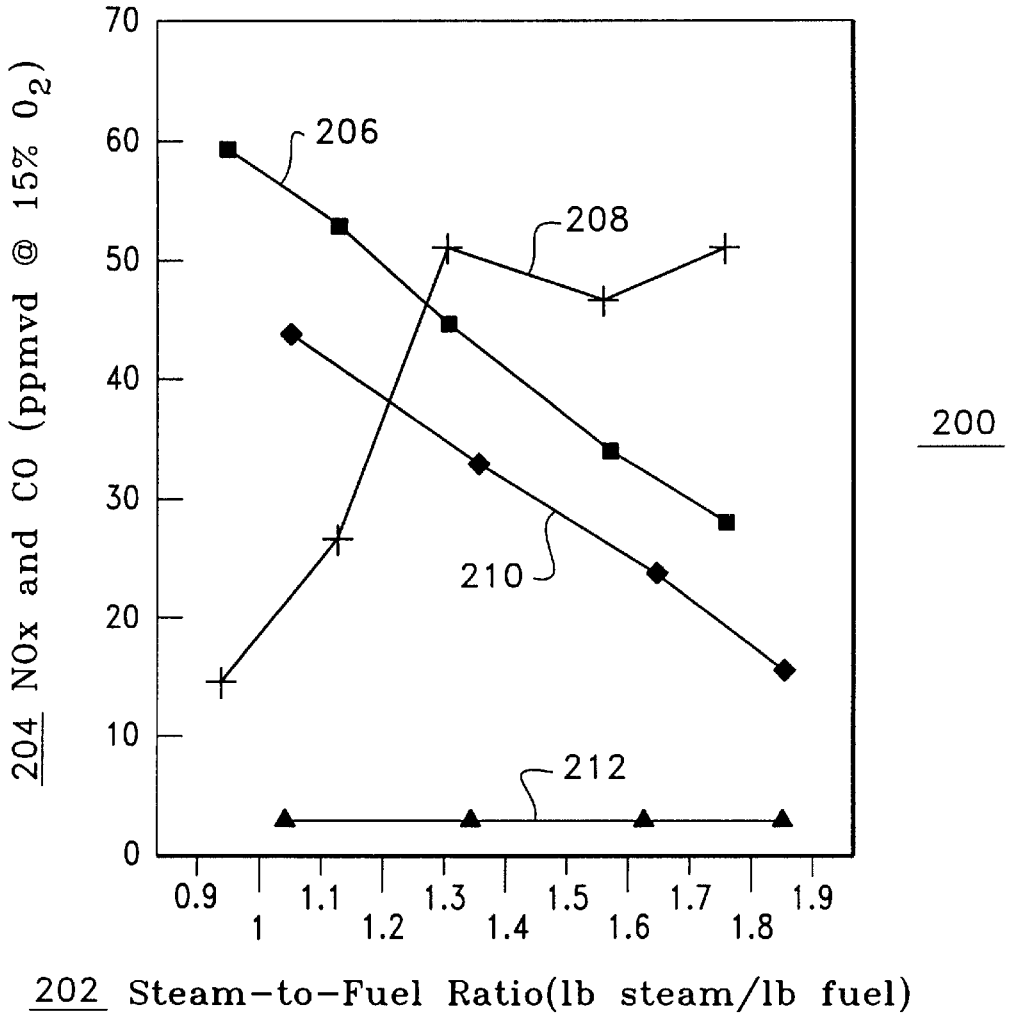
FIG. 4 shows a graph entitled "Comparison of Emissions of Separate Fuel and Steam Flows Combustion with Emissions of a Fuel/Steam Flow Combustion in a Diffusion Flame Combustor."

The present invention resulted in reduced CO and $NO_x$ emissions levels compared to a diffusion flame combustor having a separate fuel stream and a steam flow injected therein. Referring now to FIG. 4, a graph 200 entitled "Comparison of Emissions of Separate Fuel and Steam Flows Combustion with Emissions of a Fuel/Steam Flow Combustion in a Diffusion Flame Combustor" has an x-axis 202 entitled "Steam-to-Fuel Ration (lb steam/lb fuel)" and a y-axis 204 entitled "$NO_x$ and CO (ppmvd @ 15% $O_2$)." Plot lines 206 and 208 respectively show the $NO_x$ and CO emissions levels for the method of injecting separate steam and fuel streams into the combustor at different steam-to-fuel ratios. Plot lines 210 and 212 respectively show the $NO_x$ and CO emissions levels for the invention at different steam-to-fuel ratios. The graph 200 shows that the invention is an improvement over combusting separate steam and fuel streams for both the $NO_x$ and CO emissions levels as the plot line 206 is higher than the plot line 210 and the plot line 208 is higher than the plot line 212 for the graphed steam-to-fuel ratios.

The present invention may be practiced with or without the diffusion flame combustors 14 being a component of a turbine system 10 so as to supply emissions to other types of systems. Accordingly, the present invention may be embodied in other specific forms without departing from the spirit or essential attributes thereof and, accordingly, reference should be made to the appended claims, rather than to the foregoing specification, as indicating the scope of the invention.

We claim:

1. A method of combusting a liquid fuel stream in a combustor comprising the steps of:

a) spraying the liquid fuel stream into a steam flow with an atomizing means for atomizing the fuel stream to produce a fuel/steam flow;

b) mixing said fuel/steam flow;

c) combusting said fuel/steam flow in the combustor to produce at least a first portion of an emission stream;

d) monitoring a characteristic of a component of the emission stream and providing a representative output measurement;

e) comparing the measurement against a predetermined standard and identifying any variance; and f) adjusting the ratio of the fuel/steam flow to reduce the variance.

2. The method of claim 1, further comprising the steps of:

a) prior to spraying directing a start-up fuel stream into the combustor;

b) combusting said start-up fuel stream to produce at least a second portion of said emission stream, and c) reducing the flow of said start-up fuel stream into the combustor after a given period of combustor operation.

3. The method of claim 2, where said reducing the flow step occurs, at least in part, concurrently with said spraying step.

4. The method of claim 1, further comprising the step of heating up a water stream with the thermal energy of said emission stream to produce at least a portion of said steam flow.

5. The method of claim 1, further comprising the steps of:

a) determining an $NO_x$ level in said emission stream; and b) increasing said steam-to-fuel ratio when said $NO_x$ level is above an $NO_x$ emission ceiling limit.

6. The method of claim 1, wherein a) the monitoring step determines an $NO_x$ level in said emission stream; and b) the adjusting step increases the fuel/steam ratio when said $NO_x$ level is below an $NO_x$ emission floor limit.

7. The method of claim 1, wherein a) the monitoring step determines a presence of color in said emission stream; and b) the adjusting step decreases the fuel/steam ratio when said presence of color is in said emission stream.

8. The method of claim 1, wherein the monitoring step further comprises the step of measuring the $NO_x$ level, the color, the smoke level, the opacity, the unburned hydrocarbons, the CO level, or a combination thereof, of said emission stream.

9. A system for combusting fuel comprising:

a) a fuel line;

b) a steam line with an outlet connected to a first inlet of a combustor located up-stream of a combustion zone therein, wherein said combustor further comprises an emission stream outlet;

c) atomizer means for receiving fuel from said fuel line and spraying said fuel into said steam line; and d) control means for controlling a flow of fuel through said fuel line and controlling a flow of steam through said steam line in response to a signal characteristic of a component of an emission stream which is a product of the combustor and exists through the emission stream outlet.

10. The system of claim 1, wherein the signal is characteristic of an $NO_x$ level in the emission stream of said combustor and directs said control means based upon said $NO_x$ level.

11. The system of claim 1, wherein the signal is characteristic of a presence of color within the emission stream of said combustor and directs said control means based upon said presence of color.

12. The system of claim 1, wherein the signal is characteristic of a measurement of the composition of the emission stream of said combustor and directs the control means based upon the measured composition.

13. The system of claim 1, wherein the composition of the emission stream comprises the measurement of the $NO_x$ level, the color, the smoke level, the opacity, the unburned hydrocarbons, the CO level, or a combination thereof.

14. The system of claim 1, further comprising:

a) a start-up fuel line connected to a second inlet of said combustor located up-stream of said combustion zone therein; and b) wherein the control means controls a flow of start-up fuel through said start-up fuel line.

15. The system of claim 14, further comprising heat exchange means for heating up a water stream with the emission stream from said diffusion flame combustor to produce at least a portion of a steam flow and directing said steam flow through said steam line.

16. The system of claim 15, wherein the control means controls a start-up ramping function for measuring a property of said steam flow and directing said control means based upon said steam flow property to control the flow of fuel through the start-up fuel line.

* * * * *